United States Patent [19]

Render

[11] Patent Number: 4,594,820

[45] Date of Patent: Jun. 17, 1986

[54] DRIP EDGE ROOF MOULDING

[76] Inventor: Tommee E. Render, P.O. Box 245, Lewiston, Mich. 49756

[21] Appl. No.: 656,642

[22] Filed: Oct. 1, 1984

[51] Int. Cl.[4] ..... E04B 7/00; E04D 13/00

[52] U.S. Cl. ..... 52/60; 52/94

[58] Field of Search ..... 52/60, 11, 94, 97

[56] References Cited

U.S. PATENT DOCUMENTS

| | | | |
|---|---|---|---|
| 227,682 | 5/1880 | Foster et al. | 52/94 |
| 1,480,246 | 1/1924 | Douglas | 52/94 |
| 1,935,829 | 11/1933 | Bever | 52/60 |
| 3,242,622 | 3/1966 | Snead | 52/94 |
| 3,243,926 | 4/1966 | Keyt | 52/94 |
| 3,436,877 | 4/1969 | Gunning | 52/94 |
| 4,079,561 | 3/1978 | Vallee | 52/94 X |
| 4,218,857 | 8/1980 | Vallee | 52/94 |
| 4,254,594 | 3/1981 | Hammond et al. | 52/94 X |
| 4,411,120 | 10/1983 | Ellis et al. | 52/94 X |
| 4,483,112 | 11/1984 | Rueblinger | 52/94 |

*Primary Examiner*—J. Karl Bell

*Attorney, Agent, or Firm*—Barnes, Kisselle, Raisch, Choate, Whittemore & Hulbert

[57] ABSTRACT

A drip edge roof moulding for placement at the lower edge of an inclined roof beneath the roofing to direct flow of water away from the fascia board which comprises an elongated strip comprising a first flat portion adapted to be positioned beneath the roofing, a second flat portion extending downwardly from the lower edge of the first portion at an obtuse angle with respect to the first portion, a third portion extending along the second portion toward the first portion, a fourth portion extending along the underside of the first portion, a fifth portion extending downwardly at an acute angle approaching 90° from the fourth portion and adapted to engage the fascia board, and a sixth lip portion extending downwardly and outwardly at an obtuse angle to the fifth portion.

8 Claims, 4 Drawing Figures

DRIP EDGE ROOF MOULDING

This invention relates to drip edge roof mouldings.

BACKGROUND AND SUMMARY OF THE INVENTION

In the building of buildings such as homes, it is common to provide a drip edge roof moulding at the free edge of the inclined roof beneath the roofing to direct flow of water away from the fascia board which extends generally vertically below the roof in spaced relation to the free edge of the roof. The drip edge roof moulding also functions to strengthen the roofing such as shingles which extend in overhanging relation to the fascia, to cover and protect the otherwise exposed roof sheathing above the fascia and to trim out and hold in place aluminum or vinyl fascia covering where it is used.

If the water is not properly directed away from the fascia board, problems arise with peeling of paint and rotting of the wood fascia boards, staining and streaking of the aluminum or vinyl fascia coverings, blackening or discoloration of more durable material used for fascia boards such as cedar, and water running behind the eaves trough rather than dripping into it.

A common type of drip edge roof moulding is of the type shown in U.S. Pat. No. 3,415,019 wherein the moulding comprises a first portion adapted to extend along the roof beneath the roofing, a second portion bent from the free edge of the first portion below the first portion, a third portion extending downwardly from the second portion along the fascia board and a fifth lip portion extending downwardly and outwardly from the fourth portion. Such a moulding has been found to have all the aforementioned problems. Similar mouldings are shown in U.S. Pat. Nos. 4,079,561, 4,218,857 and 873,407. Much more complex structures have been suggested as shown in U.S. Pat. Nos. 667,821, 936,040, 4,271,643 and 4,300,319.

Among the objectives of the present invention are to provide a drip edge roof moulding which will effectively direct water away from the fascia board and obviate all the problems with the prior constructions; which is effective on roofs of various inclinations without change; which is low in cost and has long life.

In accordance with the invention, the drip edge roof moulding for placement at the lower edge of an inclined roof beneath the roofing to direct flow of water away from the fascia board comprises an elongated strip comprising a first flat portion adapted to be positioned beneath the roofing, a second flat portion extending downwardly from the lower edge of the first portion at an obtuse angle with respect to the first portion, a third portion extending along the second portion toward the first portion, a fourth portion extending along the underside of the first portion, a fifth portion extending downwardly at an acute angle approaching 90° from the fourth portion and adapted to engage the fascia board, and a sixth lip portion extending downwardly and outwardly at an obtuse angle to the fifth portion.

DESCRIPTION

Figure 1:
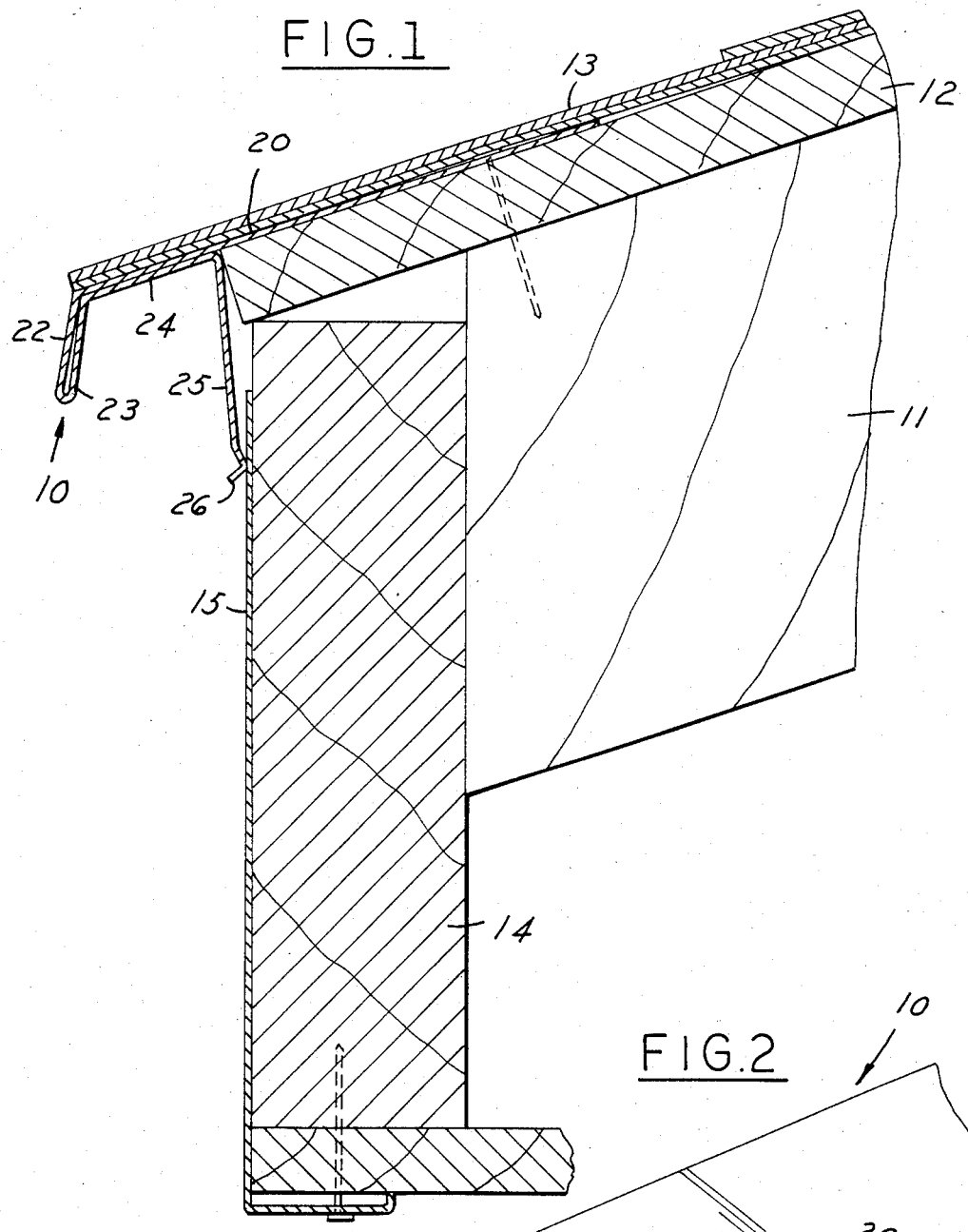
FIG. 1 is a fragmentary vertical sectional view of a building embodying the invention.
Figure 2:
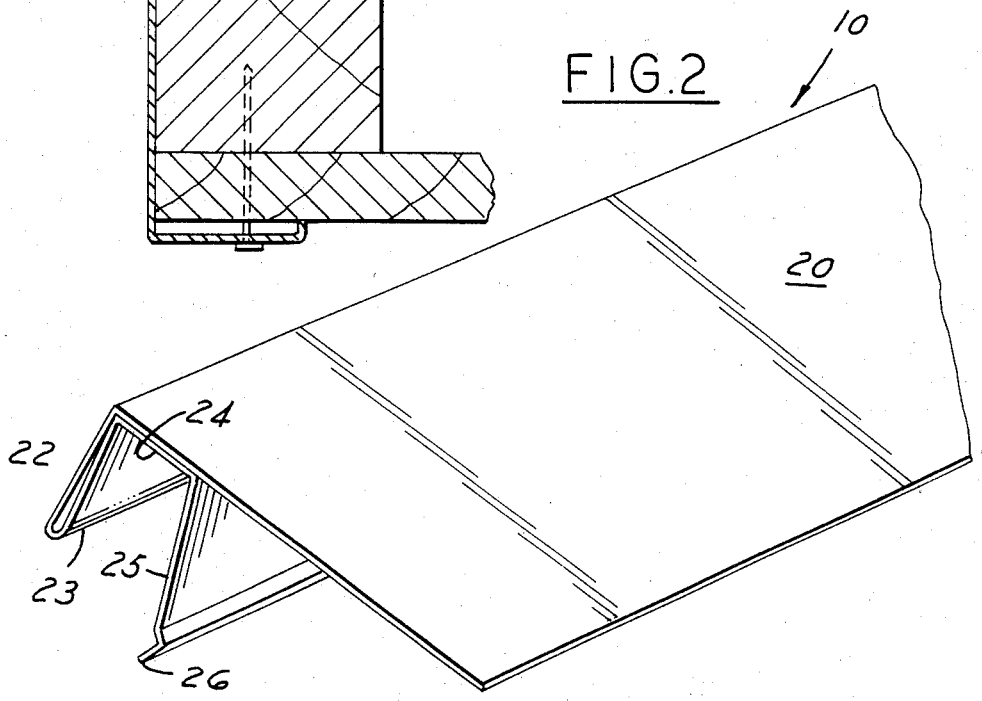
FIG. 2 is a fragmentary perspective view of the drip edge roof moulding.
Figure 3:
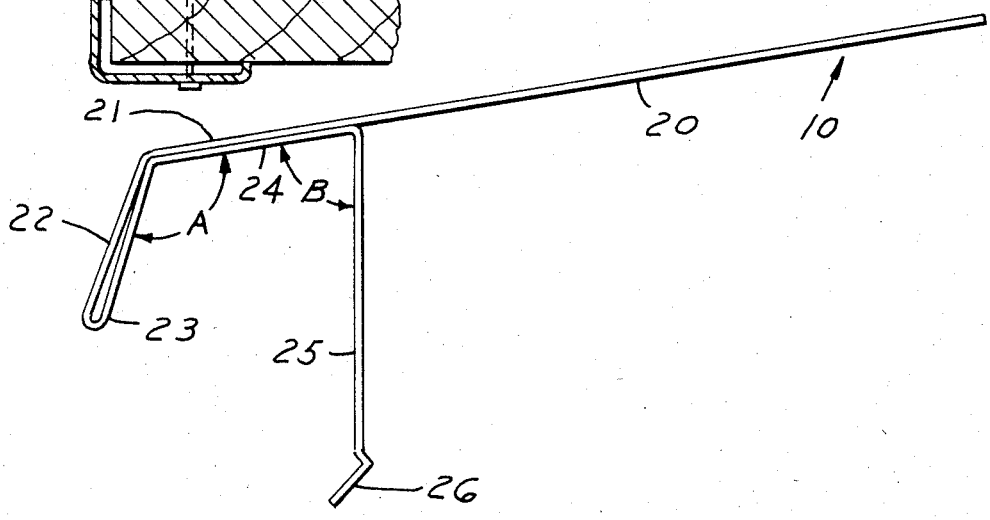
FIG. 3 is an end view of a drip edge roof moulding embodying the invention.

Referring to FIGS. 1–3, the drip edge roof moulding 10 embodying the invention is shown as being used with a building such as a home including a truss or rafter tail 11 on which roof sheathing 12 is provided. Roofing such as shingles 13 is provided over the roof sheathing 12 and extends beyond the sheathing 12 in overhanging relation to a vertical fascia board 14. Aluminum or vinyl fascia covering 15 may be provided over the fascia board.

The drip edge roof moulding 10 is preferably made from an elongated metal strip of galvanized steel and is preferably coated with an industrial baked enamel paint. The moulding is preferably roll formed from a flat sheet.

In accordance with the invention, the drip edge roof moulding 10 comprises a first flat portion 20 adapted to be positioned beneath the roofing and a second flat portion 21 bent and extending downwardly from the lower edge of the first portion 20 at an obtuse angle with respect to the first portion 20. A third portion 23 is bent from the free edge of the second portion 21 and extends along the second portion 21 toward the first portion 20. A fourth portion 24 extends in abutting relation along the underside of the first portion 20. A fifth portion 25 is bent from the free edge of the fourth portion 24 and extends downwardly at an acute angle approaching 90° from the fourth portion 24 and is adapted to engage the fascia board 14 and hold the facia covering, if any, in position. The fascia covering 15 is never fastened to the front surface of the fascia board 14 to avoid unsightly buckling of the fascia covering. A sixth lip portion 26 is bent from the fifth portion and extends downwardly and outwardly at an obtuse angle to the fifth portion 25.

The obtuse angle A which the first and fourth portions make with the second and third portions is 115° plus or minus 2°. The acute angle B which the fourth and fifth portions form is 75° plus or minus 2°.

When the drip edge moulding embodying the invention is applied as shown in FIG. 1, it effectively directs water away from the fascia board and obviates the problems with the prior constructions, is effective on roofs of various inclinations without change and is low in cost and has long life.

Figure 4:
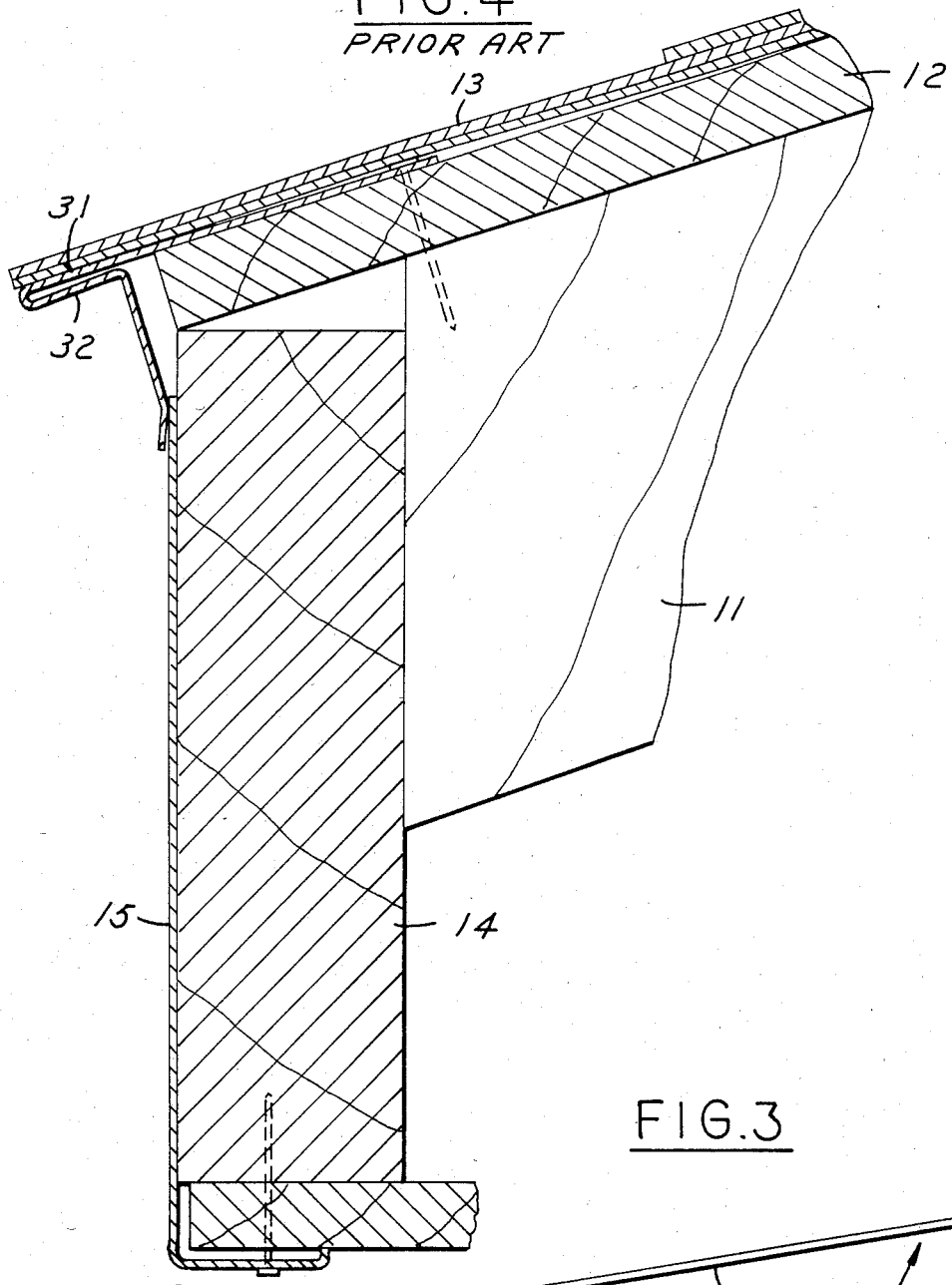
FIG. 4 PRIOR ART
FIG. 4 is a fragmentary vertical sectional view of a building incorporating a prior art drip edge roof moulding.

This may be contrasted to the prior art construction shown in FIG. 4 wherein the drip edge roof moulding has a free edge 30 formed by portions 31,32 bent over in overlapping relation such that the water tends to flow back around the free edge and runs down onto the fascia board with the resultant damage heretofore discussed. It has been found that the water moves about the free edge by capillary action along the under surface of the portion 32.

I claim:

1. In a building comprising an inclined roof including roof sheathing and roofing overlying the sheathing and having a free edge including a general vertical fascia board substantially aligned vertically with the free edge of said roof, a drip edge roof moulding construction for placement at the lower edge of an inclined roof beneath the roofing to direct flow of water away from the fascia board comprising an elongated strip comprising a first flat portion positioned beneath the roofing in overlying relation to the roof sheathing, means extending through said flat portion for holding said strip in position on said roof sheathing and comprising substantially the sole means for holding said strip in position said flat portion extending outwardly beyond said free edge of said roof and the plane of said fascia board, a second generally flat portion integrally connected to the edge of said first flat portion and extending downwardly from the lower edge of the first portion at an obtuse angle with respect to the first portion, a third portion integrally connected to said second portion and extending along the second portion toward the first portion such that water falling on the roof is directed by gravity downwardly from the juncture of the second portion and third portion, the length of said third portion being sustantially equal to the length of said second portion, a fourth portion integrally connected to the edge of said third portion extending along the underside of the first portion in abutting relation thereto, a fifth portion integrally connected to the edge of said fourth portion and extending downwardly at an acute angle approaching 90° with the fourth portion and engaging the fascia board, and a sixth lip portion integrally connected to the edge of the fifth portion and extending downwardly and outwardly at an obtuse angle to the fifth portion.

2. The drip edge roof moulding set forth in claim 1 wherein said moulding is formed from a single strip by bending.

3. The drip edge roof moulding construction set forth in claim 1 wherein the obtuse angle between the first and second portions is about 115°.

4. The drip edge roof moulding construction set forth in claim 3 wherein the angle comprises 115° plus or minus 2°.

5. The drip edge roof moulding construction set forth in claim 1 wherein the angle formed between the fourth and fifth portions is about 75°.

6. The drip edge roof moulding construction set forth in claim 5 wherein the angle formed between the fourth and fifth portions is 75° plus or minus 2°.

7. The drip edge roof moulding set forth in claim 1 wherein said building comprises a fascia covering over the fascia board, means fastening said fascia covering to said fascia board at a point vertically below the upper edge of said fascia covering and comprising the sole fastening means holding said fascia covering on said fascia board such that the upper edge of said fascia covering is unattached with respect to said fascia, said fifth portion holding the upper edge of said fascia covering against said fascia board.

8. In a building comprising an inclined roof including roof sheathing and roofing overlying the sheathing and having a free edge including a general vertical fascia board substantially aligned vertically with the free edge of said roof, a drip edge roof moulding construction for placement at the lower edge of an inclined roof beneath the roofing to direct flow of water away from the fascia board comprising an elongated strip comprising a first flat portion positioned beneath the roofing in overlying relation to the roof sheathing, means extending through said flat portion for holding said strip in position on said roof sheathing and comprising substantially the sole means for holding said strip in position said flat portion extending outwardly beyond said free edge of said roof and the plane of said fascia board a second generally flat portion integrally connected to the edge of said first flat portion and extending downwardly from the lower edge of the first portion at an obtuse angle with respect to the first portion, a third portion integrally connected to said second portion and extending along the second portion toward the first portion such that water falling on the roof is directed by gravity downwardly from the juncture of the second portion and third portion, the length of said third portion being substantially equal to the length of said second portion, a fourth portion integrally connected to the edge of said third portion extending along the underside of the first portion in abutting relation thereto, a fifth portion integrally connected to the edge of said fourth portion and extending downwardly at an acute angle of 75° plus or minus 2° with the fourth portion and adapted to engage the fascia board, and a sixth lip portion integrally connected to the edge of the fifth portion and extending downwardly and outwardly at an obtuse angle to the fifth portion.

* * * * *